US008061284B2

(12) United States Patent
Kongo et al.

(10) Patent No.: US 8,061,284 B2
(45) Date of Patent: Nov. 22, 2011

(54) STIPPLING PATTERN STITCHING APPARATUS AND SEWING MACHINE

(75) Inventors: Takeshi Kongo, Tokyo (JP); Hiromi Motoyama, Tokyo (JP); Naoki Sugahara, Tokyo (JP)

(73) Assignee: Janome Sewing Machine, Co., Ltd., Tokyo (JP)

( * ) Notice: Subject to any disclaimer, the term of this patent is extended or adjusted under 35 U.S.C. 154(b) by 365 days.

(21) Appl. No.: 12/387,973

(22) Filed: May 11, 2009

(65) Prior Publication Data

US 2010/0024700 A1 Feb. 4, 2010

(30) Foreign Application Priority Data

Jul. 31, 2008 (JP) ..... 2008-197457

(51) Int. Cl.
*D05B 21/00* (2006.01)

(52) U.S. Cl. ..... 112/102.5

(58) Field of Classification Search ..... 112/80.23, 112/80.3, 102, 102.5, 470.1, 470.3, 470.4, 112/470.5, 475.18; 700/131, 136–138
See application file for complete search history.

(56) References Cited

U.S. PATENT DOCUMENTS 5,430,658 A * 7/1995 Divinsky et al. ..... 700/138
5,510,994 A * 4/1996 Tsonis et al. ..... 700/137
5,957,068 A * 9/1999 Mizuno ..... 112/102.5
5,960,726 A * 10/1999 Yamada ..... 112/102.5
6,098,559 A * 8/2000 Hirose ..... 112/475.19

FOREIGN PATENT DOCUMENTS

JP 2008-136623 6/2008

* cited by examiner

*Primary Examiner* — Tejash Patel
(74) *Attorney, Agent, or Firm* — Nielda, Lemack & Frame, LLC

(57) ABSTRACT

The invention discloses an apparatus for easily stitching a stippling pattern, wherein the stippling pattern 20 is selected and the vertical and lateral lengths XY of an embroidering area 30 are designated. In response to the designation, a pattern number calculating device 4 is operated to calculate the number (integer) of the vertical and lateral lengths of the unit stippling pattern that may be arranged in the embroidering area 30 in alignment vertically and laterally, and then a magnification calculating device is operated to calculate the magnification of the unit stippling pattern respectively of the vertical and lateral lengths of the unit stippling pattern, the calculation being made on the basis of the calculated number of the vertical and lateral lengths of the unit stippling pattern and the size of the embroidering area 30 so that the size of whole pattern may be in accord with the size of the embroidering area 30. In case the calculated magnification is decided as exceeding a predetermined limit value, a warning is indicated so that another unit stippling pattern 20 of different size may be selected. In case the calculated magnification is decided as being not in excess of the predetermined limit value, a stitch data modifying device 6 is operated to enlarge and reduce the stitch data of the pattern on the basis of the calculated magnification rate so that the pattern may be stitched in accordance with the so processed stitch data.

9 Claims, 7 Drawing Sheets

STIPPLING PATTERN STITCHING APPARATUS AND SEWING MACHINE

BACKGROUND OF THE INVENTION

The Present invention relates to stippling pattern stitching apparatus and sewing machine.

The stippling pattern is such a pattern as being depicted by a continuous line that is variously and complicatedly extended as is curved. The pattern is generally used for kilting stitches and the like.

The stippling pattern is generally stitched by manual operation by use of so called a free motion technique. Namely the stitching operation speed of sewing machine needle is adjusted by manipulation of a machine motor controller with manual adjustment of transporting amount of cloth while the feed dog is made ineffective as is moved to a lower position. However a special skill is required to stitch a proper stippling pattern because it is required that the cloth transporting amount and the stitching operation speed of sewing machine needle are simultaneously adjusted so that the pitch width of stitches may be maintained constant. It is, therefore, almost impossible for the machine users in general to stitch the stippling pattern at a large kilt cloth by use of a sewing machine.

Under such circumstances, it has been recently proposed to mechanically stitch the stippling pattern as shown in the document JP-A-20(2008)-136623 by way of example. The document discloses a technique to automatically produce the stippling pattern data.

SUMMARY OF THE INVENTION

In case the stippling pattern is stitched mechanically by use of a sewing machine, it is impossible to stitch the stippling pattern at a time in a large stitching area. In this case, it is required to stitch the stippling pattern while the pattern is divided. Actually it has been contemplated to provide an apparatus for solving the problems such as how to divide the pattern, how to adapt the pattern to the size of the cloth where the pattern is embroidered and so on.

It is, therefore, an object of the invention to solve such problems.

For the purpose of attaining the object, the apparatus of the invention comprises an embroidery size input device for inputting a size of embroidering area of an object where a pattern is embroidered, a pattern memory for storing therein at least one unit pattern data including stitch data for a unit pattern having predetermined vertical and lateral lengths to be embroidered, a pattern selecting device for selecting a predetermined unit pattern data from the pattern memory, a pattern number calculating device for calculating out the number that is an integer of the predetermined vertical and lateral lengths of the unit pattern in accordance with the size of embroidering area of the object where the pattern is embroidered, the calculation being made on the basis of the size of embroidering area of the of the object where the pattern is embroidered and the predetermined vertical and lateral lengths of the selected unit pattern, a magnification calculating device for calculating out the enlarging/reducing rates respectively of the vertical and lateral lengths of the unit pattern in compliance with the size of embroidering area of the of the object where the pattern is embroidered, the calculation being made on the basis of the number of the vertical and lateral lengths of the unit pattern that is calculated out at the pattern number calculating means and the size of embroidering area of the object where the pattern is embroidered, a stitch modifying device for enlarging/reducing the stitch data of the unit pattern in vertical and lateral directions in accordance with the enlarging/reducing rates calculated at the magnification calculating device.

The unit pattern data includes indicating data for indicating stitching information at the display, printing data for operating a printer to print out the stitching information and other data needed for stitching operation as well as the stitch data for controlling the needle dropping points of a pattern.

The unit pattern of the unit pattern data has predetermined vertical and lateral lengths. The size of the unit pattern corresponds to the size of a part area where the unit pattern may be embroidered normally by one time pattern stitching operation and the part area normally corresponds to the size of the embroidering frame that is used to hold the object where a pattern is embroidered. The pattern memory may store therein the pattern data of unit pattern having vertical and lateral lengths which are different from each other. A plurality of pattern data for unit patterns of a same size may be used in case one embroidery pattern is completed by use of a plurality of unit patterns or by combination of a plurality of unit patterns of different sizes.

The object where the pattern is embroidered is typically a cloth. An entire area where a pattern is embroidered is decided at the cloth. The entire area that is the embroidery size is inputted at the embroidery size input device by a machine user. The embroidery size is normally larger than the part area that is the size of the embroidering frame. The embroidery size is such as to attain an entire embroidery by plural times of pattern stitching operations wherein the cloth is reset to the embroidering frame so many times.

The pattern number calculating device calculates out the number that is the integer of the unit patterns having vertical and lateral lengths that will satisfy the embroidery size to be stitched, the calculation being made on the basis of the embroidery size and the predetermined vertical and lateral lengths of unit pattern of the selected unit pattern data. Normally the embroidery size and the combination of unit patterns are not in accord with each other. Therefore the magnification calculating device is provided to calculate out the enlarging/reducing rates for rendering in accord the embroidery size and the combination of unit patterns. On the basis of the enlarging/reducing rates thus calculated out, the stitch modifying device is operated to modify the stitch data of the unit pattern data. The enlarging/reducing rates are calculated out independently as to the vertical and lateral lengths of the unit pattern. In this connection, the enlarging/reducing rates are 1 in case the embroidery size and the combination of unit patterns are in accord with each other.

Incidentally the apparatus for stitching a stippling pattern may further comprise an enlarging /reducing rate deciding device for deciding if the enlarging /reducing rates calculated at the magnification calculating device exceed predetermined values, and an indicating device for indicating the fact decided at the enlarging /reducing rate deciding device.

According to the invention, the pattern memory may store therein a plurality of unit patterns including different patterns or including same patterns having different vertical and lateral lengths. The pattern selecting device may select from the pattern memory other unit patterns of different vertical and lateral lengths in case the enlarging/reducing rate deciding device decides that the designated enlarging/reducing rates exceed predetermined values. The selection by the pattern selecting device may be optionally made by operation of the machine user or may be automatically made by a predetermined algorithm.

Further the apparatus of the invention may be provided with a printer for printing out the unit patterns of the stitch data enlarged/reduced at the stitch modifying device in the manner that the unit patterns are arranged in alignment vertically and laterally by the number as calculated out at the pattern number calculating device. Further the apparatus of the invention may be provided so as to be used in combination with a sewing machine.

According to the stippling pattern stitching apparatus or the sewing machine of the invention, a stippling pattern may be easily stitched at the entire area of a large cloth without a special skill. Especially according to the invention, the machine user is no longer required to manipulate the cloth and may easily and safely produce a large stippling pattern. Further as the vertical and lateral lengths of unit stippling pattern may be enlarged and reduced independently, the number that is the integer of the unit stippling patterns may be easily arranged in alignment vertically and laterally in a predetermined size of a kilt fabric. Further with preparation of a plurality of unit stippling patterns of different sizes which may be enlarged and reduced, the unit stippling pattern may be embroidered to the kilt fabrics of various sizes.

Figure 1:
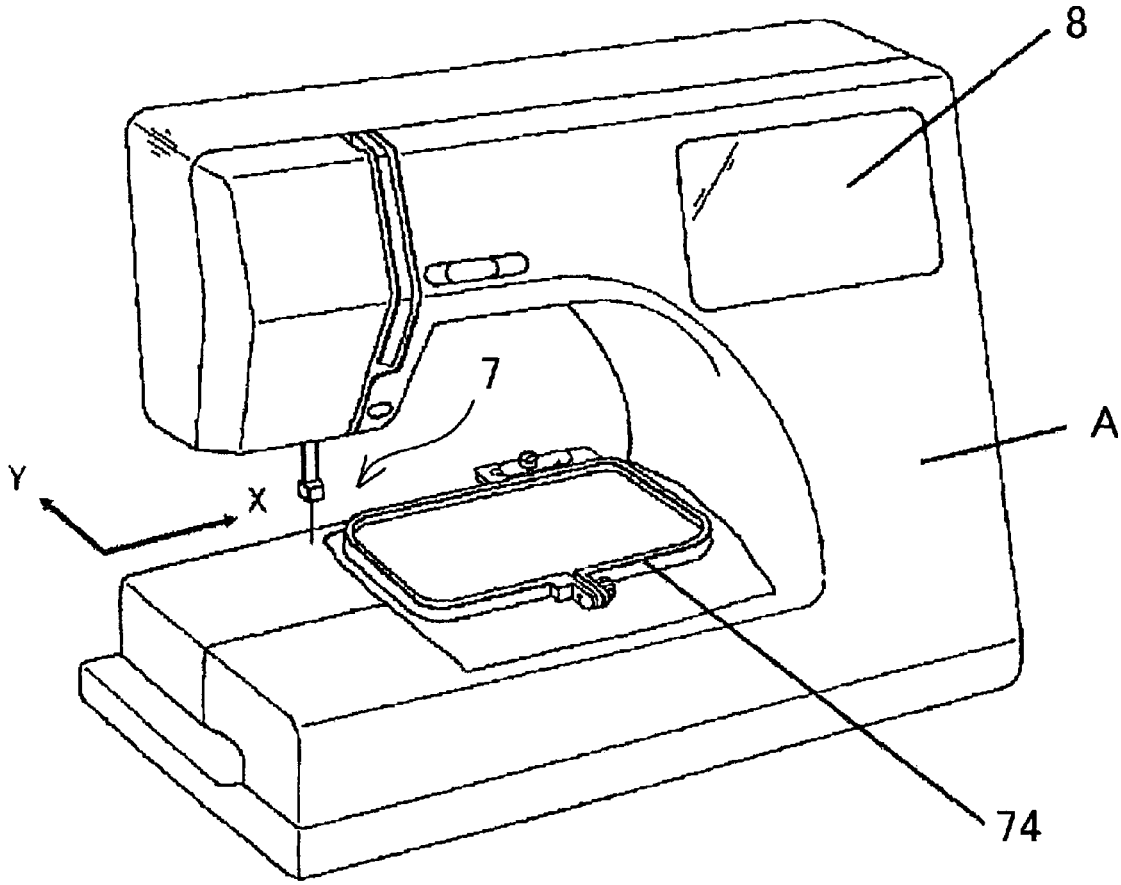
FIG. 1 is a perspective view of one embodiment of the invention shown by way of example.

1: Pattern selecting device
2: Pattern memory
3: Embroidery size input device
4: A pattern number calculating device
5: A magnification calculating device
6: Stitch modifying device
7: Stitching mechanism
8: Display
9: Printer
10: Selection input device
20: Stippling pattern
30: Cloth
50: Enlarging/reducing rate deciding device
70: Machine motor control device
71: Machine motor
72: X, Y motor control device
73: X, Y motors
74: Embroidering frame
80: Display control device
90: Printer driving device
100: Central processing unit (CPU)

DETAILED DESCRIPTION OF THE PREFERRED EMBODIMENTS

The invention will be described in reference to a preferred embodiment as shown in the attached drawings.

FIG. 1 shows an embodiment of the invention that is composed of a stippling pattern stitching apparatus which is built in a sewing machine and is adapted to producing embroidery stitches.

The sewing machine A is provided with a stitching mechanism 7 and a display 8, and is so formed as to have an embroidering frame 74 attached thereto in case the stippling pattern stitching operation is carried out. The embroidering frame 74 is so formed as to have a cloth set thereto at which a stippling pattern is to be embroidered. The cloth is resettable on the embroidering frame 74 so that a stippling pattern of a size larger than the size of the embroidering frame 74 may be stitched at the cloth while the cloth is displaced relative to the embroidering frame 74.

Figure 2:
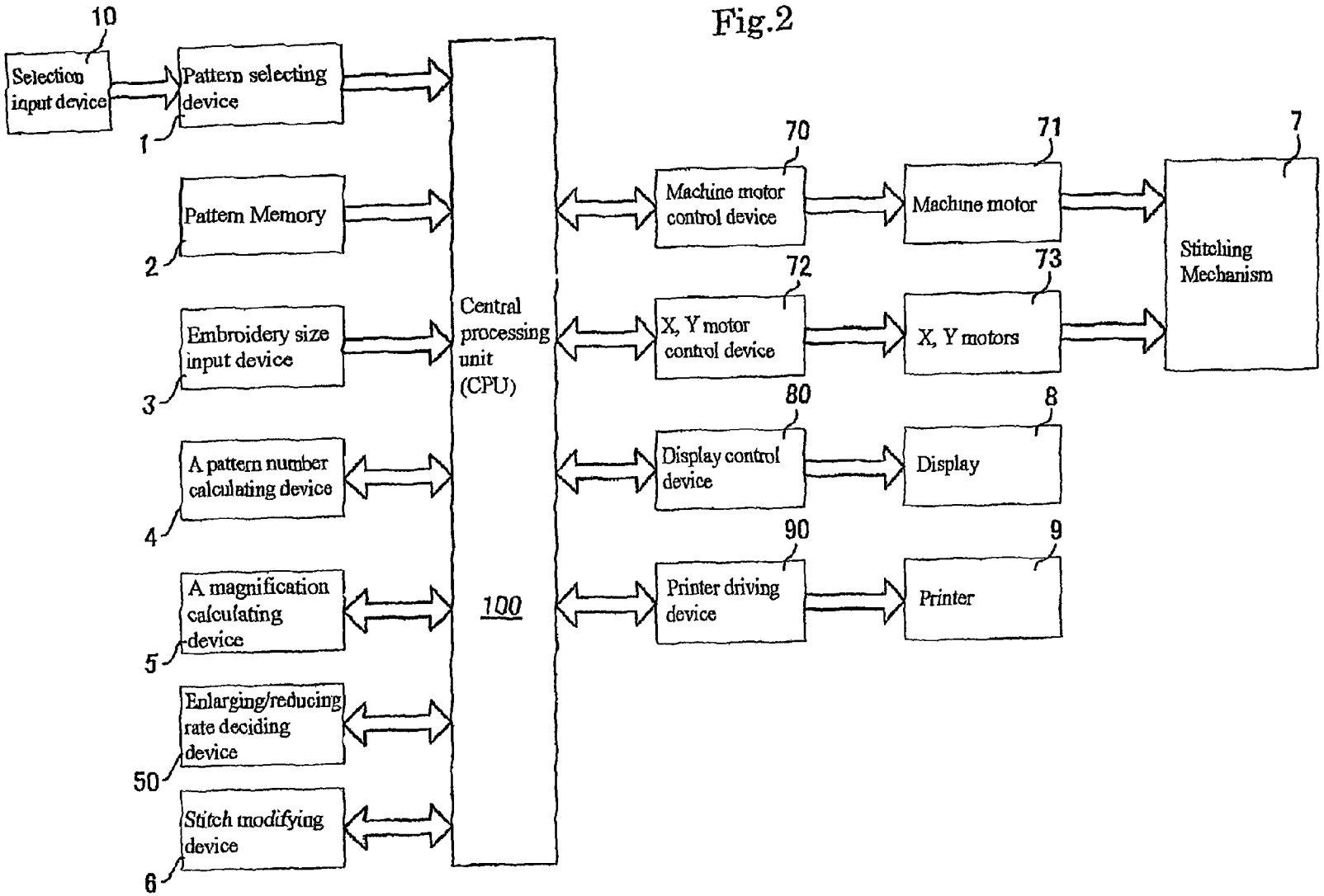
FIG. 2 is a block diagram showing the functions of the embodiment of the invention.

The embodiment of the invention will be further described in detail in reference to the block diagram as shown in FIG. 2.

The sewing machine A is operated under control of a central processing unit 100 (CPU). The sewing machine A has a machine motor control device 70 that is operated under instruction of the CPU 100 so as to control the rotation speed of a machine motor 71 thereby to control the operation of a stitching mechanism 7 including a needle and a feed dog for actually forming stitches at the cloth. Further the CPU 100 controls an X, Y motor control device 72 so as to control the operation of X and Y motors 73 for moving in the X and Y directions the embroidering frame 74 that is operatively connected to the stitching mechanism 7. Thus the stippling pattern may be stitched.

Further the CPU 100 controls the operation of a display control device 80 so that a display 8 may indicate thereat the information needed for stitching operation.

The CPU 100 has a pattern memory 2 connected thereto. The pattern memory 2 stores therein unit pattern data for at least one stippling pattern. The unit pattern data includes the stitch data for embroidery stitching operation, indicating data for indicating a pattern at the display 8, printing data for printing the indicated pattern and other data required for stitching operation.

Figure 7:
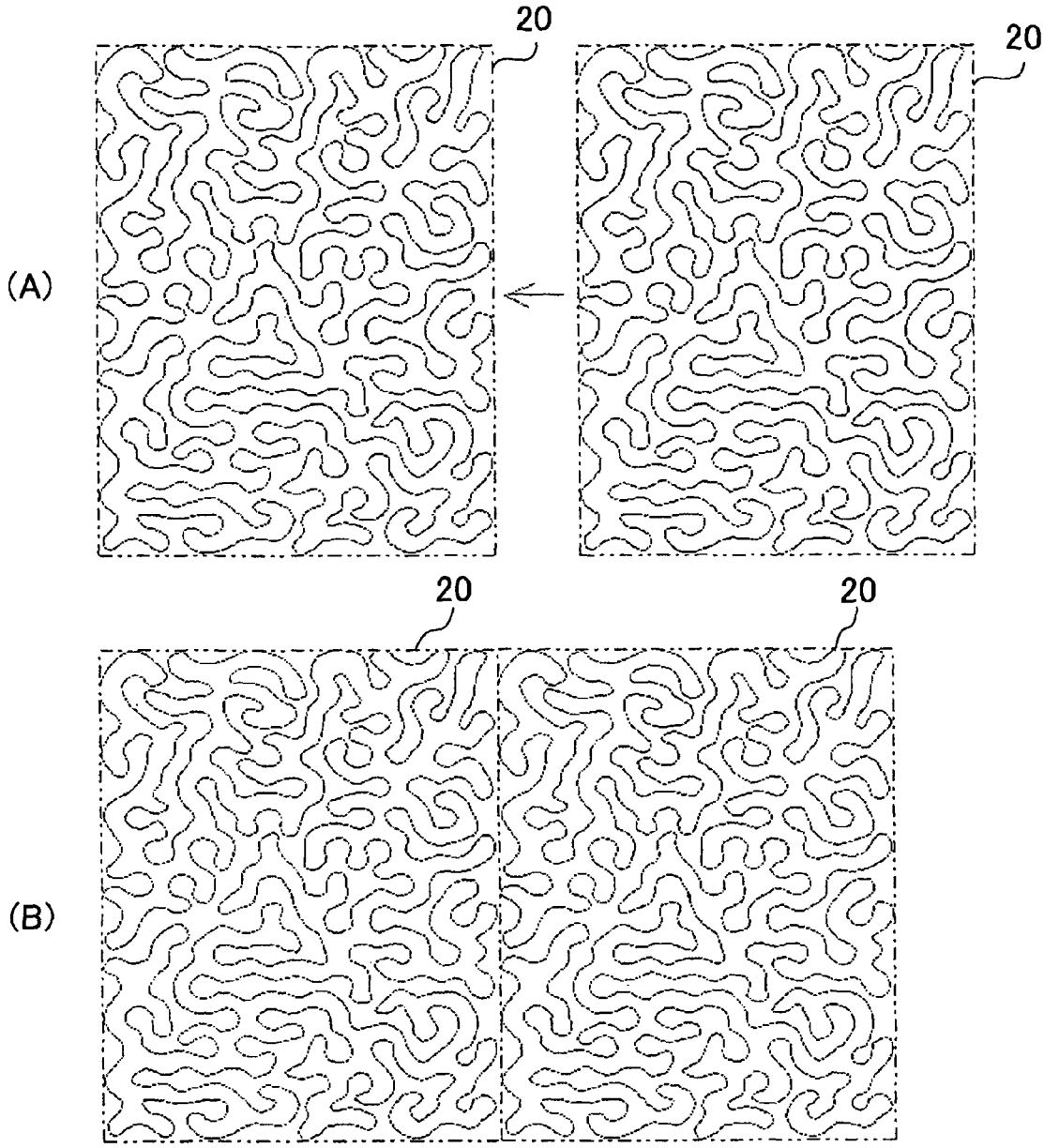
FIG. 7 is an explanatory view showing the operations of the embodiment of the invention.

FIG. 7 shows a stippling pattern 20 by way of example. As shown, the stippling pattern 20 is a complicated pattern depicted by one continuous line. The unit pattern data stored in the pattern memory 2 includes the stitch date for stitching such stippling pattern 20.

According to the invention, a kilt cloth is set to the embroidering frame as is tensed thereon and a plurality of selected stippling patterns 20 are embroidered at the kilt cloth as are arranged in alignment vertically and laterally in combination as will be described in detail hereinlater. In this case, as shown in FIG. 7, the unit stippling patterns 20 are embroidered in such manner that the concave and convex portions that are depicted adjacent to the circumferential boundaries of one unit stippling pattern 20 are stitched as arranged substantially opposite to the convex and concave portions of the other unit stippling pattern 20 at the junction between the two unit stripping patterns 20, so that the finished embroidery pattern may be so large as united into one pattern.

Figure 4:
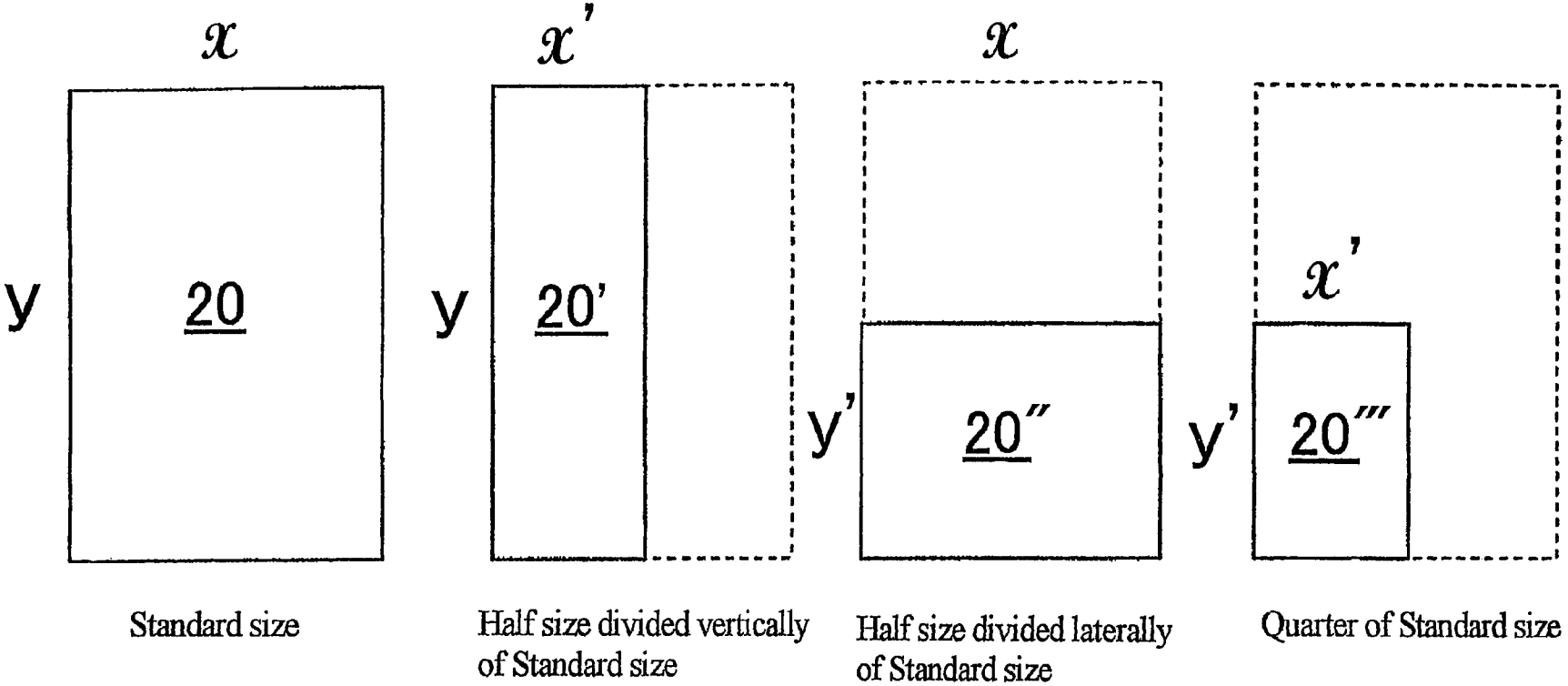
FIG. 4 is an explanatory view showing the types of stippling pattern 20 that may be produced by means of the embodiment of the invention.

As shown in FIG. 4, the stippling pattern 20 has a size as defined by the outline and has predetermined lateral and vertical measures x and y. According to the embodiment, the stippling pattern 20 is of a standard size with pattern data x and y; the stippling pattern 20' is of a half size as divided vertically of the standard sized stippling pattern 20 and is of pattern data x'=½x and y; the stippling pattern 20" is of a half size as divided laterally of the standard sized stippling pattern 20 and is of pattern data x' and y=½y; and the stippling patter 20'" is of a size that is ¼of the standard sized stippling pattern 20 and is of pattern data x'=½x and y'=½y.

The standard sized stippling pattern 20 has the vertical and lateral lengths corresponding to the vertical and lateral lengths of the embroidering frame 74, but the measures of the standard sized stippling pattern 20 are slightly smaller than the measures of embroidering frame 74.

Incidentally the pattern data for different stippling patterns may be additionally stored in the pattern memory 2.

A pattern selecting device 1 is provided for selecting the data for the stippling pattern 20 stored in the pattern memory 2. The CPU 100 is operated to read out from the pattern memory 2 the pattern data selected by the pattern selecting device 1. The pattern selecting device 1 includes a selection input device 10 that is operated by a machine user to designate the stippling pattern 20. In this connection, the pattern selecting device 1 may be provided with a predetermined algorithm for selecting the stippling pattern 20. The pattern data of the stippling pattern that is selected and read out from the pattern memory 2 is stored in a temporary memory (not shown) that is included in the CPU 100.

Incidentally the stippling pattern 20 is normally stitched as is composed of a plurality of same patterns. However the stippling patterns 20, 20', 20" of different sizes may be stitched in combination.

An embroidery size input device 3 is provided so as to be operated by the machine user to input the size of embroidering area of the cloth where a selected pattern is embroidered (hereinafter called "embroidery size"). The machine user is required to input the embroidery size of the cloth where the stippling pattern is embroidered by designation of the vertical and lateral lengths. Generally the stippling pattern is embroidered at a considerably large cloth. It is, therefore, inevitable that the size of the cloth is larger than the size of the stippling pattern 20.

According to the embodiment of the invention, a plurality of stippling patterns 20 which are to be embroidered in combination are arranged in alignment vertically and laterally in the embroidery size X, Y of a predetermined embroidering area 30 of a kilt cloth while the size of the unit stippling pattern 20 is adjusted.

A pattern number calculating device 4 is provided to calculate out the number that is the integer of vertical and lateral lengths of the unit pattern that corresponds to the embroidery size of the object where a pattern is embroidered, the calculation being made on the basis of the embroidery size of the object and the predetermined vertical and lateral lengths of selected unit pattern. Namely the pattern number calculating device 4 will calculate out the number of stippling pattern 20 that is to be arranged laterally in alignment and the number of stippling pattern 20 that is to be arranged vertically in alignment that correspond to the embroidery size of the object where the pattern is embroidered, the calculation being made on the basis of the vertical and lateral lengths of the pattern selected at the pattern selecting device 1 and the vertical and lateral lengths of the embroidery size designated at the embroidery size input device 3.

The embodiment of the invention will be described more precisely in reference to FIGS. 5 and 6.

Figure 5:
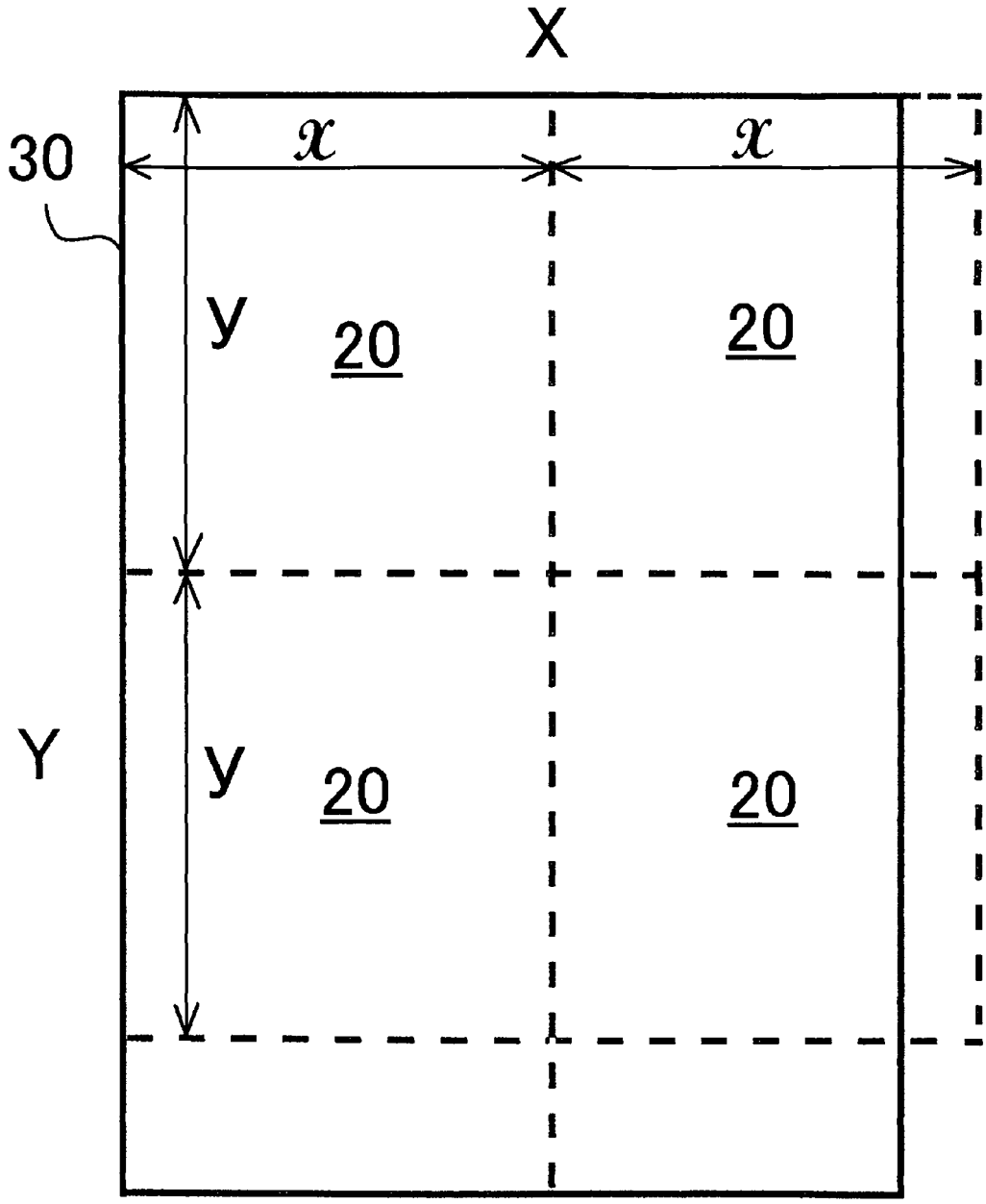
FIG. 5 is an explanatory view showing the operations of the embodiment of the invention.

As shown in FIG. 5, in case the stippling pattern 20 of lateral size x and vertical size y is embroidered in the embroidering area 30 of the size that is of lateral size X and of vertical size Y of the cloth that is to be embroidered, two stippling patterns 20 may be arranged in alignment laterally and vertically as shown. On the other hand, as shown in FIG. 6, two stippling patterns 20 may be arranged in alignment laterally and three stippling patterns 20 may be arranged in alignment vertically.

Normally the number of the patterns that is the integer may be obtained by calculation of $X \div x$ and $Y \div y$ and by rounding off. Further the integer may be sought by rounding down and by rounding up so as to select the arrangement by small rate of enlargement and reduction as will be described more in detail hereinlater.

Figure 6:
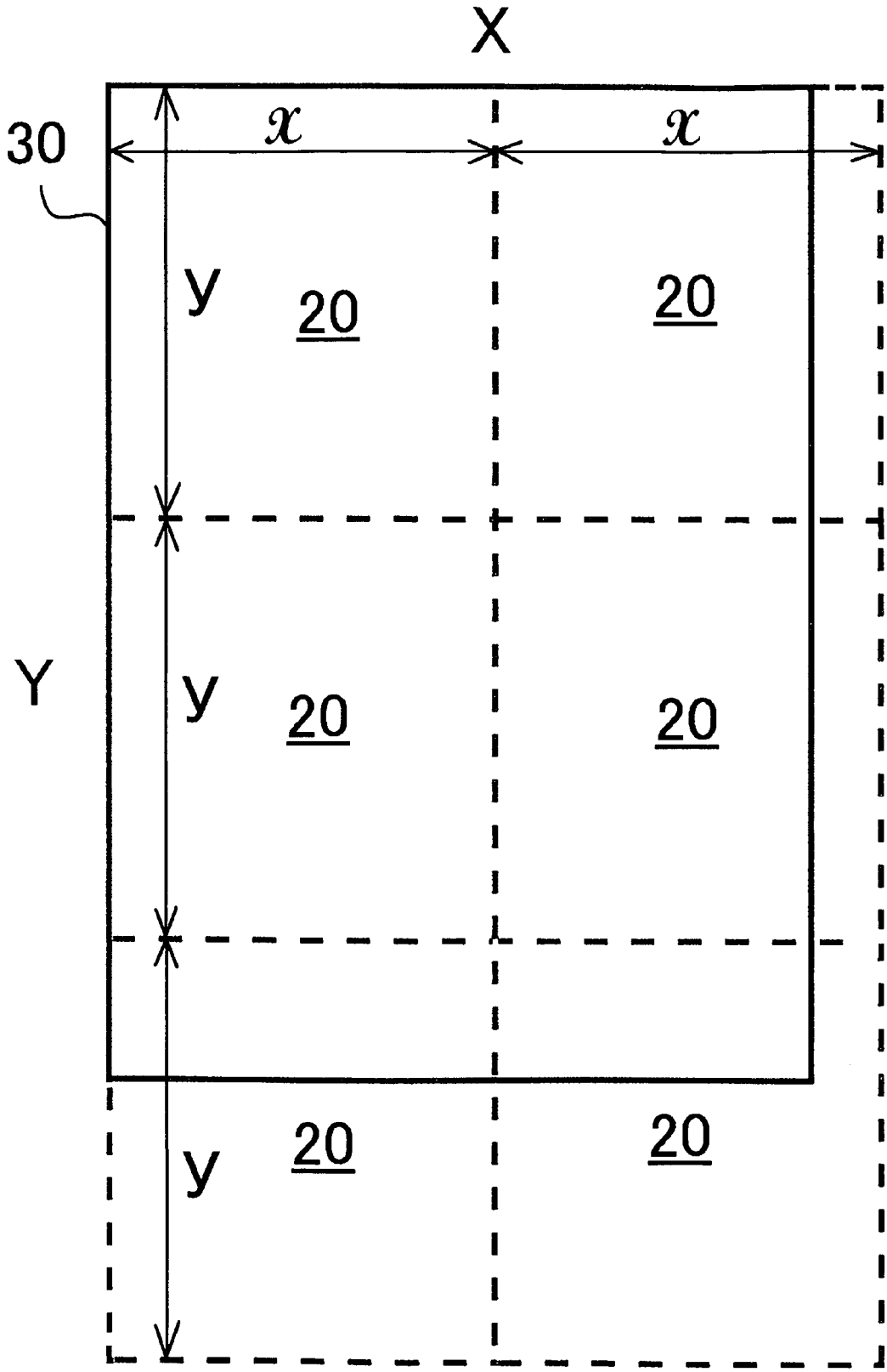
FIG. 6 is an explanatory view showing the operations of the embodiment of the invention.

As shown in FIGS. 5 and 6, the arrangement of stippling patterns 20 indicated by calculation at the pattern number calculating device 4 is generally not completely adapted for the size of the embroidering area 30. In this connection, a stitch modifying device 6 is provided. The stitch modifying device 6 is so formed as to enlarge and reduce the stippling pattern data in lateral and vertical directions independently in order that $x \times$number of stippling patterns 20 arranged laterally and $y \times$number of stippling pattern 20 arranged vertically may be in accord with the XY of embroidering area 30 in compliance with the arrangement of stippling patterns calculated out at the pattern number calculating device 4. Namely the stitch data of stippling pattern 20 is multiplied by enlarging and reducing rates $\alpha$, $\beta$ respectively so as to enlarge and reduce the stippling pattern 20 in lateral and vertical directions. As the result, the lateral and vertical sizes of stippling pattern 20 will become $x \times \alpha$, $y \times \beta$respectively. The enlarged and reduced vertical and lateral sizes of stippling pattern 20 are adapted to the XY of the embroidering area 30, that is, $X = x \times \alpha \times$number of stippling patterns arranged in alignment laterally and $Y = y \times \beta \times$number of stippling patterns arranged in alignment vertically.

In this connection, the stitch modifying device 6 will multiply the stitch data of stippling pattern by 1 in case the size of stippling pattern 20 is in accord with the size of embroidering area 30 in vertical and/or lateral direction.

As to the enlargement and reduction of embroidery pattern, the vertical and lateral magnifications are normally same in order to prevent the deformation of the pattern. However according to the invention, the size of unit stippling pattern 20 is adjusted by enlargement and reduction in vertical and lateral directions which are made independently so as to obtain the stippling pattern that is embroidered in accordance with the size of the embroidering area 30 because the stippling pattern 20 has a characteristic that will give no particular impression of deformity. Further according to the invention, as a plurality of stippling patterns 20 are arranged so as to be embroidered in combination, the stippling patterns 20 may be smoothly arranged side by side as particularly shown in FIG. 7 where a particular discrepancy is prevented from being caused at the junction between the unit stippling patterns 20, the discrepancy being often caused by cut of thread during stitching operation or by simple arrangement of patterns.

The sewing machine A is provided with a printer 9 that may be operated to print the pattern to be stitched in the embroidering area 30. Namely the printer 9 prints out a whole of the stippling patterns 20 which are arranged in alignment vertically and laterally and enlarged and reduced in accordance with the embroidering area 30, so that the printed pattern may be used for positional adjustment between the embroidering area 30 and the embroidering frame 74.

The number of patterns arranged in alignment vertically and laterally, the magnification rate of patterns, stitching information, drafting information and the template of unit stippling pattern may be outputted to the printer.

Further the CPU 100 is provided with a magnification calculating device 5 and an enlarging and reducing rate deciding device 50. The enlarging and reducing rate deciding device 50 is provided to decide if the enlarging/reducing rates calculated at the magnification calculating device 5 exceed predetermined values. In case the enlarging/reducing rates exceed the predetermined values, the fact is indicated at the display 8. The predetermined values may be set as the limit magnifications that will prevent the deformation of pattern.

Further the CPU 100 is so formed as to cause the pattern selecting device 1 to select the stippling patterns 20 of different sizes from the pattern memory 2 in accordance with the instruction of machine user or predetermined algorithm in case the enlarging/reducing rate deciding device 50 decides that the designated enlarging/reducing rates exceed the predetermined values. Namely as shown in FIG. 4, in case the enlarging/reducing rates are decided as exceeding the predetermined values as to the pattern of standard size, the pattern of another size may be selected among the patterns of vertical half size, of lateral half size and of quarter size, or the patterns of different sizes may be selected in proper combination. In this case the first and second calculating devices 4 and 5 are operated accordingly. Even in case a pattern of new size is selected, it may happen that the enlarging/reducing rates are decided as exceeding the predetermined values. In this case, it is required to repeat the same pattern size selecting operation.

Figure 3:
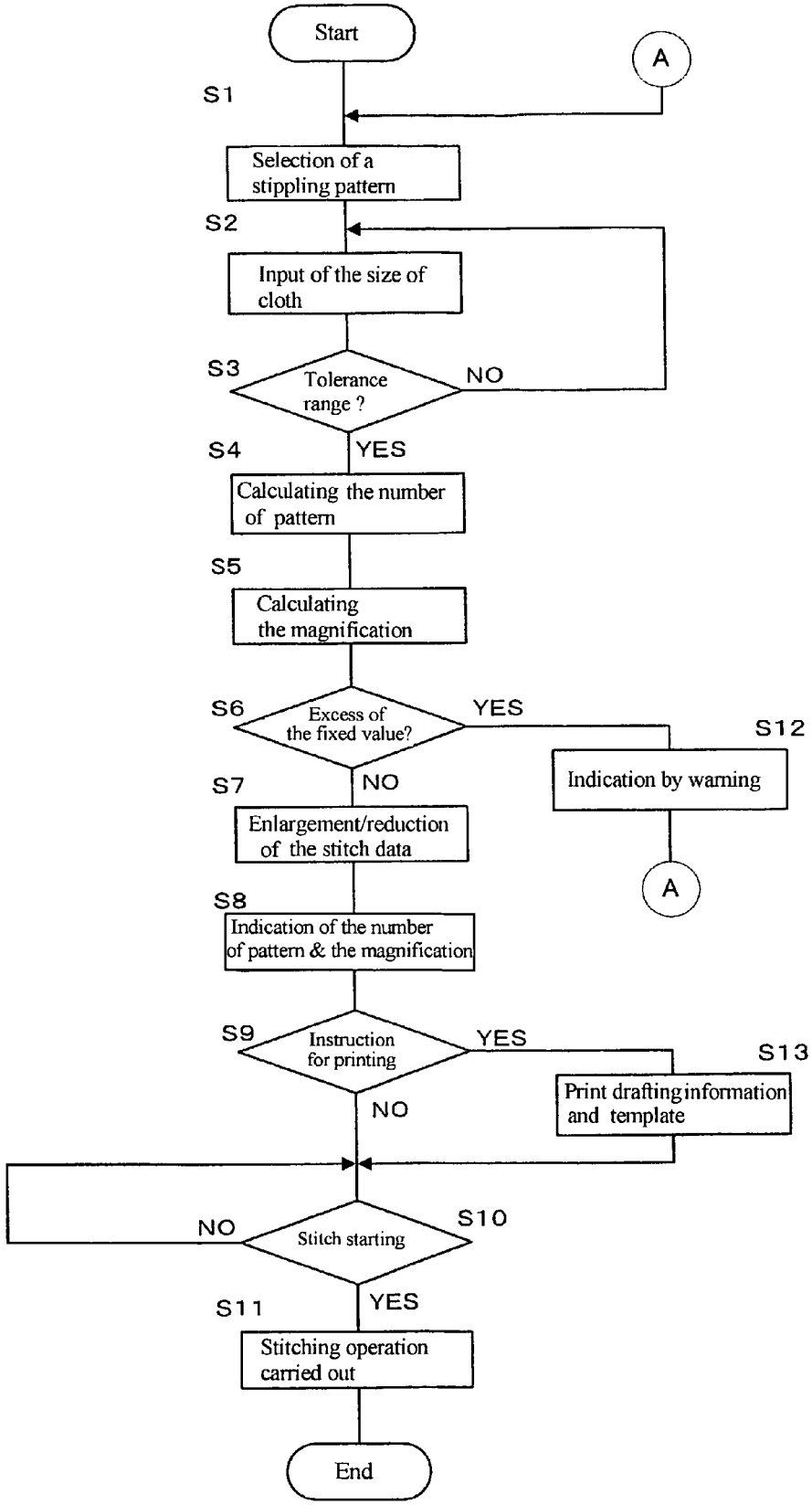
FIG. 3 is a flowchart showing the operations of the embodiment of the invention.

Subsequently the operation of the invention will described in reference to the flowchart as shown in FIG. 3.

A stippling pattern 20 is selected among those which are read out from the pattern memory 2 and indicated at the display 8 (step S1). Designation is made as to the vertical and lateral lengths XY of the embroidering area 30 where the selected pattern is embroidered (steps S2, S3). The pattern number calculating device 4 calculates out the number (integer) of the selected patterns which are to be arranged in alignment vertically and laterally in the embroidering area 30 of the XY size (step S4). Calculation is made as to the vertical and lateral magnifications of the selected unit stippling pattern 20 respectively so that the size of the pattern may be in accord with the size of the embroidering area 30, the calculation being made on the basis of calculated number of patterns and the size of the embroidering area 30 (step S5).

In case the calculated magnifications exceed the predetermined limit values beyond which the pattern is deformed (step S6), the fact is indicated at the display 8 (step S12) and the routine returns to the step S1 and another unit stippling pattern 20 of different size is selected (step S1) and the subsequent same operations are repeated.

The stitch data of the stippling pattern 20 is enlarged and reduced at the stitch modifying device 6 on the basis of the calculated magnifications (step S7) in case the selected enlarging/reducing magnifications are not in excess of the predetermined values. The display indicates the information including the number of patterns to be arranged in alignment vertically and laterally and the vertical and lateral magnifications of pattern (step S8). In case the instruction for printing is given (step S9), Inputting to the printer the stitch information is inputted to the printer, the stitch information including drafting information and the template of unit stippling pattern (step S13).

When the instruction is given for starting the stitching operation (step S10), the CPU 100 controls the machine motor control device 70 and the X, Y motor control device 72 so as to stitch the enlarged and reduced stippling patterns 20 by the number of patterns arranged in alignment vertically and laterally as calculated out at the first calculating device 4 (step S11).

What is claimed is:

1. An Apparatus for stitching a stippling pattern comprising: an embroidery size input means for inputting a size of embroidering area of an object where a pattern is embroidered, a pattern memory for storing therein at least one unit patter data including stitch data for a unit pattern having predetermined vertical and lateral lengths, a pattern selecting means for selecting the stitch data for the unit pattern from the pattern memory means, a pattern number calculating means for calculating out the number that is an integer of the vertical and lateral lengths of the unit pattern to be stitched in accordance with the size of embroidering area of the object where the pattern is embroidered, the calculation being made on the basis of the size of embroidering area of the of the object where the pattern is embroidered and the predetermined vertical and lateral lengths of the selected unit pattern, a magnification calculating means for calculating out the enlarging/reducing rates respectively of the vertical and lateral lengths of the unit pattern in compliance with the size of embroidering area of the of the object where the pattern is embroidered, the calculation being made on the basis of the number of the vertical and lateral lengths of the unit pattern calculated out at the pattern number calculating means and the size of embroidering area of the of the object where the pattern is embroidered, a stitch modifying means for enlarging/reducing the stitch data of the unit pattern in vertical and lateral directions in accordance with the enlarging/reducing rates in the vertical and lateral directions which are calculated at the magnification calculating means.

2. The apparatus for stitching a stippling pattern as defined in claim 1, further comprising: an enlarging/reducing rate deciding means for deciding if the enlarging/reducing rates calculated at the magnification calculating means exceed predetermined values, an indicating means for indicating the fact decided by the enlarging/reducing rate deciding means.

3. The apparatus for stitching a stippling pattern as defined in claim 1, wherein the pattern memory means stores therein the pattern data for a plurality of unit patterns having predetermined vertical and lateral lengths, at least one of which is different from the other.

4. The apparatus for stitching a stippling pattern as defined in claim 3, wherein the pattern selecting means may be operated to select the pattern data for an optional one of the plurality of unit patterns.

5. The apparatus for stitching a stippling pattern as defined in claim 4, wherein the pattern selecting means may be operated to select the pattern data for a plurality of unit patterns having predetermined vertical and lateral lengths, at least one of which is different respectively of the patterns.

6. The apparatus for stitching a stippling pattern as defined in claim 3, further comprising: an enlarging/reducing rate deciding means for deciding if the enlarging/reducing rates calculated at the magnification calculating means exceed predetermined values, and wherein the pattern selecting means may be operated to select from the pattern memory means the pattern data for another unit pattern having predetermined vertical and lateral lengths, at least one of which is different from the other in case the enlarging/reducing rate deciding means decides that the calculated enlarging/reducing rates exceed the predetermined values.

7. The apparatus for stitching a stippling pattern as defined in claim 6, wherein the pattern selecting means may be operated to select the pattern data for a plurality of unit patterns having predetermined vertical and lateral lengths, at least one of which is different respectively of the patterns.

8. The apparatus for stitching a stippling pattern as defined in claim 1, further comprising a printer for printing the unit patterns of the stitch data enlarged/reduced at the stitch modifying means and arranged in accordance with the number of vertical and lateral lengths as calculated out at the pattern number calculating means.

9. A sewing machine that is provided with the apparatus as defined in claim 1.

* * * * *